US005439323A

United States Patent [19]

Nance

[11] Patent Number: 5,439,323

[45] Date of Patent: Aug. 8, 1995

[54] ROD AND SHELL COMPOSITE RISER

[75] Inventor: Donald A. Nance, Los Altos, Calif.

[73] Assignee: Westinghouse Electric Corporation, Pittsburgh, Pa.

[21] Appl. No.: 89,724

[22] Filed: Jul. 9, 1993

[51] Int. Cl.[6] ..... E02B 17/00; F21B 17/01

[52] U.S. Cl. ..... 405/195.1; 166/350; 405/224; 405/223.1; 285/114

[58] Field of Search ..... 405/169-171, 405/195.1, 224.1; 166/350, 359, 367; 285/114

[56] References Cited

U.S. PATENT DOCUMENTS 580,226 4/1897 Sanford ..... 405/170

3,221,817 12/1965 De Vries et al. ..... 166/359 X 4,383,554 5/1983 Merriman ..... 166/350 X 4,470,722 9/1984 Gregory ..... 166/350 X 4,648,747 3/1987 Watkins et al. ..... 166/367 X 4,739,800 4/1988 Baratella ..... 405/171 X

*Primary Examiner*—Dennis L. Taylor

[57] ABSTRACT

A riser section for an oil or other fossil fuel floating platform is described having a high strength-to-weight ratio. The riser section includes a composite tubular shell for conveying the drilling mud, production oil, etc. and resisting its radial pressure. Such section also includes, though, a plurality of rods which extend along its length and act as tensile load carrying members.

22 Claims, 5 Drawing Sheets

ROD AND SHELL COMPOSITE RISER

The present invention relates to riser sections of riser strings of the type used with oil or other fossil fuel underwater exploration and production, and, more particularly, to such a section having a high strength-to-weight ratio.

Floating and/or semi-submerged platforms, and drill ships, are used in the drilling and production of oil or other fossil fuels from under the floor of large bodies of water, such as oceans or gulfs. A riser string typically is provided between the seabed having the actual borehole and the surface platform or ship. If a borehole is being drilled, the riser string is referred to as a drill riser and acts to shield and separate the drill bit and its string from the water. If the borehole is a fossil fuel producing well, the riser string is referred to as a production riser and acts to convey the fossil fuel to a surface platform or the like.

Both drill risers and production risers generally have been simply strings of metal tube sections. In this connection, each of the riser sections must be sufficiently strong to carry the tensile loads expected by reason of the other sections in the string. The weight of these sections has been a limiting factor relative to the depth between a platform and a seabed. Not only must each section be strong enough to carry the sections beneath it after a string is made, but also existing drilling or production ships and/or platforms can only carry a limited number of such metal sections without exceeding their maximum load limit. Current riser sections usually are constructed in 50–75 feet lengths, and an entire riser string could be up to 10,000 feet in length. Existing risers are made of steel and their self weight becomes a significant problem in depths over 3,000 feet.

SUMMARY OF THE INVENTION

The present invention provides a riser section having a significantly high strength-to-weight ratio, and its use enables drilling and production at depths over about 3,000 feet without requiring extraordinary methods. It accomplishes this by eliminating the heavy metal believed to be necessary in the past to withstand the loads and pressures to which a riser section is expected to be subjected. It separates the tensile load carrying means from the means for carrying the radial pressures expected to be applied to the riser section. That is, a riser section must be constructed to withstand the two basic forces to which it is apt to be subjected. First of all, there is the outer radial pressure that is expected from within the interior of the riser caused, for example, by drilling mud or by production fossil fuel. There is also the axial tensile load a drill riser section will be expected to carry, most of which is caused by other riser sections in a riser string and the tensioning devices. (This latter load often is a 1,000,000 lb.+tensile load.)

It has been found that a relatively light weight riser section can be provided if these two forces are separated and handled individually. That is, it has been found that a tubular composite shell can be simply provided as part of the riser section for carrying the radial pressures expected to be applied to the same, and rods or other structure can be provided for carrying the significant tensile loads. It should be noted that while it is preferred that the means for carrying the radial pressure expected to be applied to the riser section be a composite shell, it need not be. That is, from the broad standpoint the shell can be made of any material which is capable of withstanding the radial pressure. It is important, though, that this shell be relatively lightweight so as not to add significantly to the riser section mass. The important point is that the shell need not withstand the axial tensile forces to which the riser may be subjected since separate means are provided carrying the same. Most desirably, means are included at the opposed ends of the riser section for transmitting the tensile loads to adjacent riser sections in a string.

With this arrangement it will be seen that if all or a significant number of the riser sections in a string incorporate the instant invention, the total strength-to-weight ratio of the full string is such that significant depths easily can be reached. A greater number of riser sections can be accommodated both by a drill ship or floating platform and can become part of a riser string.

Other features and advantages of the invention either will become apparent or will be described in connection with the following, more detailed description of preferred embodiments of the invention.

BRIEF DESCRIPTION OF THE DRAWING

With reference to the accompanying drawing:

FIG. 7 is a sectional view similar to that of

FIG. 3 illustrating an alternate connection arrangement;

DETAILED DESCRIPTION OF THE PREFERRED EMBODIMENTS

The following relatively detailed description is provided to satisfy the patent statutes. However, it will be appreciated by those skilled in the art that various changes and modifications can be made without departing from the invention.

Figure 1:
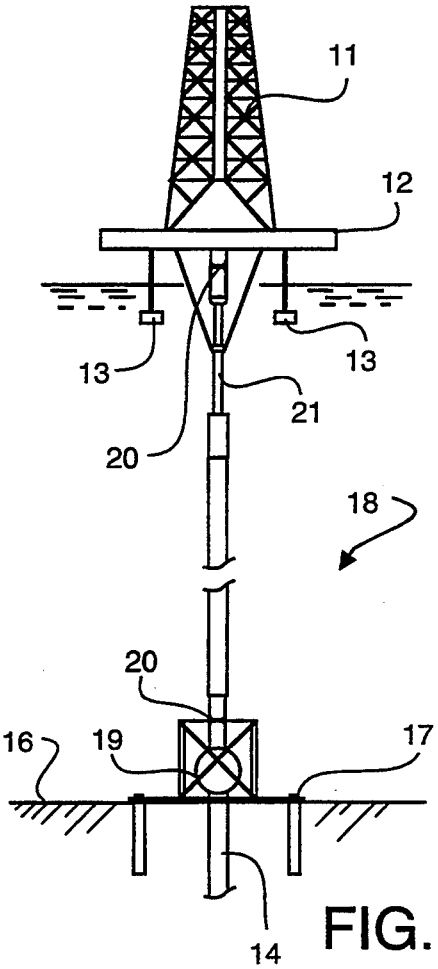
FIG. 1 is an overall diagrammatic elevation view of an undersea oil production arrangement.

FIG. 1 is a schematic illustration of a semisubmerged oil well platform arrangement, illustrating the context of the instant invention. The apparatus for either drilling a borehole or for pumping oil from a production well is schematically represented in the figure by derrick 11. As illustrated, derrick 11 is provided on platform 12 which, in turn, is supported by pontoons 13.

The actual borehole 14 projects downward from the sea floor represented at 16. A subsea platform arrangement schematically represented at 17 is provided on the sea floor.

An elongated riser arrangement generally represented at 18 extends between the borehole 14 and the platform 12. Such arrangement includes at the borehole end, a blow-out preventer (BOP) as is common, represented at 19. The riser sections themselves are connected between platforms 12 and 17 through flex joints 20 and a telescoping section 21. It will be recognized that such flex joints and the telescoping section are included to accommodate motion of the platform 12 relative to the platform 17 and, hence, undersea borehole 14.

The riser arrangement 18 is made up primarily of a plurality of elongated riser sections which are coaxially secured together to provide a riser string. Each of these sections not only must resist the pressure of the material within the same but also accommodate the tensile load which is caused by the suspension of additional riser sections from the same and the tensioner load. This tensile load typically is quite high and requires that each tubular riser section have thick metal walls and massive flanges at each end. The standard approach to this problem is to make each riser section out of steel of a sufficient thickness to accommodate the tensile load. The end flanges of standard riser sections are thick enough to accommodate the tensile induced bending loads.

Figure 2:
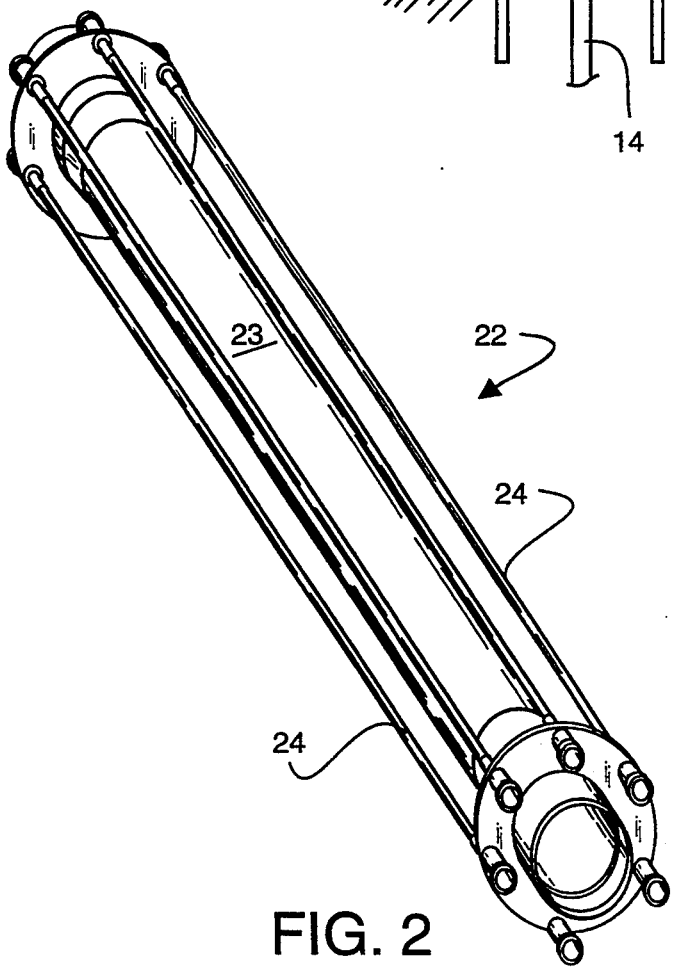
FIG. 2 is an isometric view of a preferred embodiment of the riser section of the invention.

It has been found that it is possible to provide riser sections having a significantly higher strength-to-weight ratio than has been used in the past. FIG. 2 illustrates a preferred embodiment of such a riser section. The riser section of such figure, generally referred to by the reference numeral 22, includes a tubular shell 23 for carrying the radial pressures expected to be applied to the riser section by, for example, drilling mud during a drilling operation or production gas or crude oil. The tensile loads which are expected to be applied to the riser section are carried by separate tension rods 24 which surround the shell 23, extending for the length of the riser section. Although from the broad standpoint the tensile load carrying means need not be rods and could be cables or other tensile carrying members, it is preferred that rods be used because the end connections can be simplified.

Figure 3:
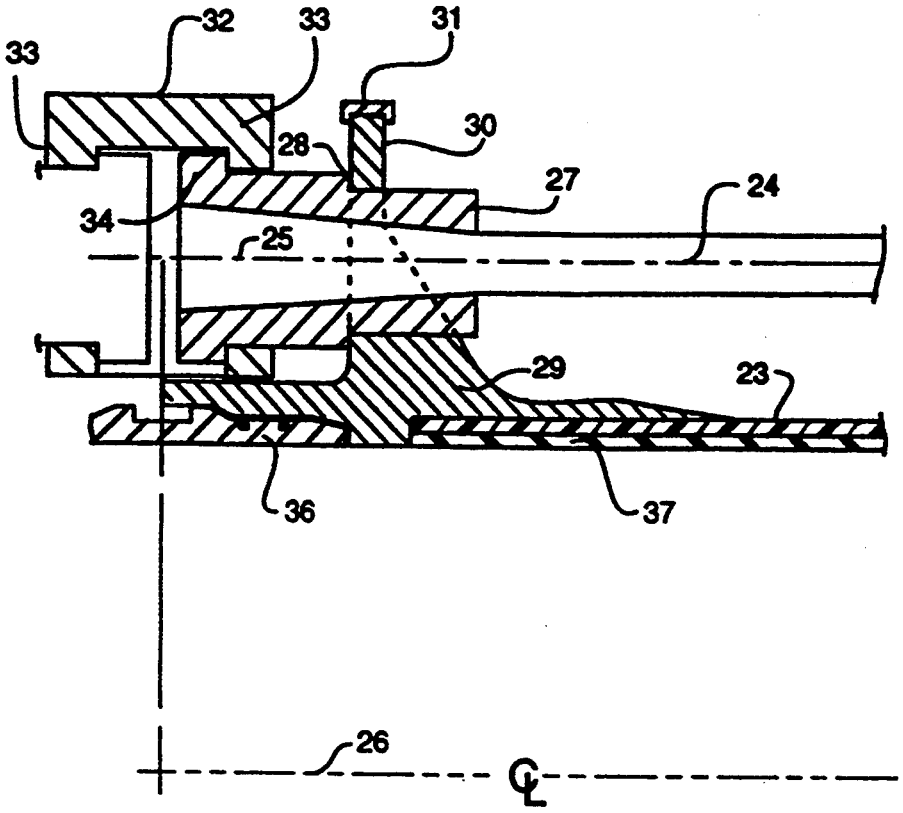
FIG. 3 is an enlarged section of an end connector/-flange arrangement of the instant invention.

Each of the rods 24 terminates at the opposed ends of the section, in means for transmitting any tensile load carried by the same to adjacent riser sections. That is, with reference to FIG. 3, in this embodiment each tension rod 24 flares outwardly at its end, as is represented at 25. Such figure is a sectional showing at the wall of the riser section as is a common way of showing such an arrangement. (It will be recognized that the actual end of the riser section will be a revolution of the section about the center line indicated at 26.) The flared end of each rod is engaged within an interiorly tapered swag fitting 27 having a shoulder 28 engaged in a slot within an end flange 29. A retainer insert 30 maintains each swag fitting in its associated slot. A strap 31 is included to maintain the rods 24 in position in the flange 29 when such rods are not under an appreciable tensile load.

Means are included for transmitting the tensile loads carried by the rods of one riser section to rods of adjacent riser sections. Such means takes the form in FIG. 3 of a connector collar 32 having inwardly directed flanges 33 which engage each of the swag fittings 27 behind an outwardly extending terminal shoulder 34. It will be seen that such connector acts not only to transmit the tensile load from a rod on one riser section to a coaxial rod on another as illustrated, but it also acts as a physical connection of one riser section to another. In this connection, a riser-to-riser seal as represented at 36 is provided to prevent passage of liquid or the like between the interior and exterior of a drill string having drill section shells 23.

It will be noted that with this arrangement the tensile load on each rod is passed directly to a corresponding rod of the adjacent riser section without ever being transmitted to other parts of its own riser section. This is one reason why it is not necessary that the flange 29 be much more than is necessary simply to locate the rods laterally with respect to the remainder of the riser section and to keep the same in place when tensile load is not applied to the same.

The shell 23 preferably is a composite shell made from two differing materials, e.g., graphite and an epoxy. It is important to note that since the shell is only expected to resist radial pressure, in manufacture the shell can be wound primarily with hoop windings and to be sized for pressure load only. For a drill riser, this means a shell made from the above materials only has to be about one-fourth inch thick. A tubular liner 37 is provided within the shell engaging the interior surface thereof. The purpose of the tubular liner is to protect the interior surface of such shell from whatever material there is to be contained by the shell, e.g., drill, drill pipe, drilling mud or crude oil. It should be noted that in prior arrangements in which the wall of the riser is thick steel, it often is not necessary to worry about damage to the wall.

Figure 4:
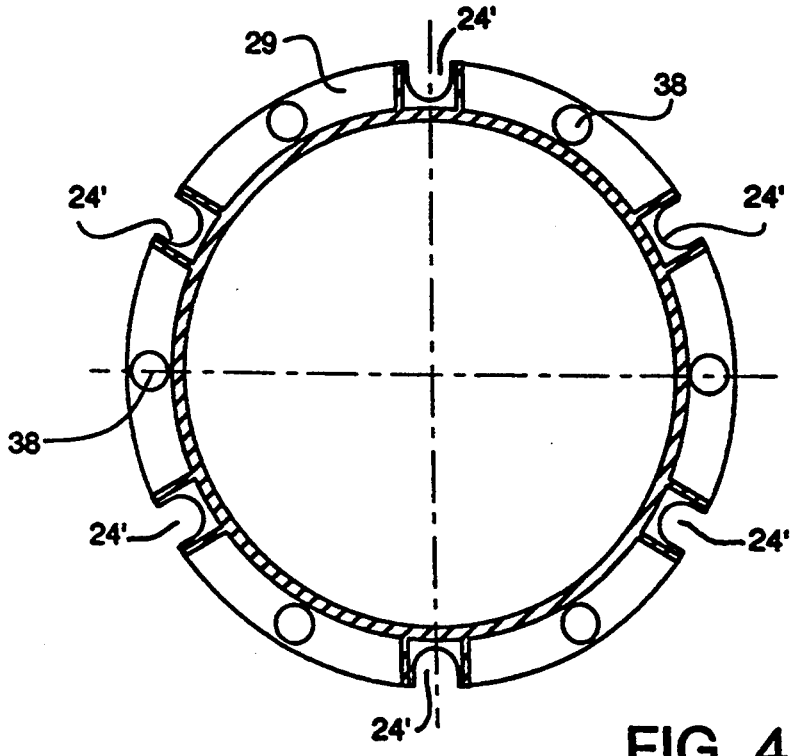
FIG. 4 is an end sectional view of a riser section, illustrating the flange of the embodiment of FIG. 2.

In an implementation of the particular embodiment being described, there are six, one and one-half inch rods 24 made from graphite. FIG. 4 shows the location of such rods and it will be seen that they are located symmetrically with respect to the central longitudinal axis of the riser section. Standard kill/choke lines, as represented at 38, also are provided extending the length of the risers located equidistance between the rods 24. It will be appreciated that if one of the tension rods 24 breaks, the other rods in the group on the riser section will take up the tensile load.

It is contemplated that a significant number of rods 24 can replace each one of the six rods which are illustrated, with the result that the tensile load is even further spread out and if one of such rods becomes useless, the additional tensile load on the other rods is a minimum. It is even contemplated that in some situations it may be desirable to have constructions in which rods may be removed for checking, replacement, etc. without having to remove a full riser section.

Figure 5:
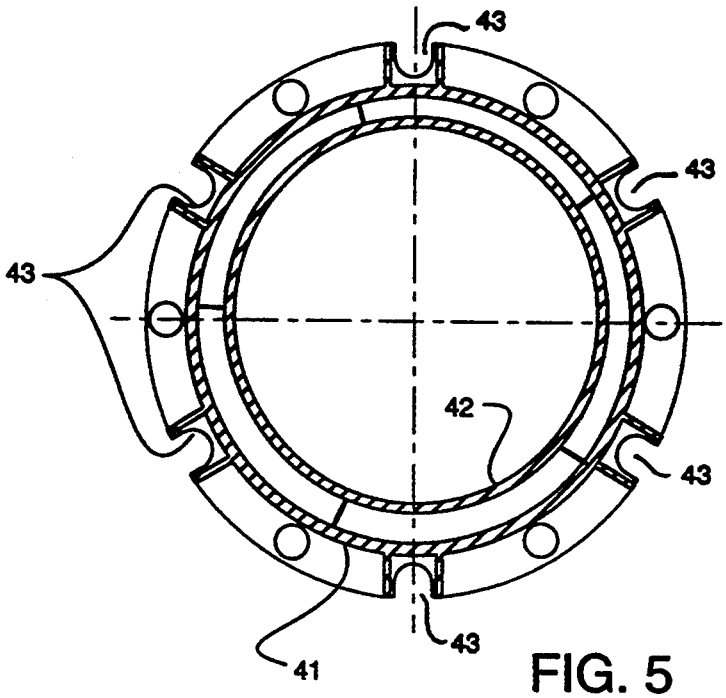
FIG. 5 is an end sectional view similar to that of FIG. 4 illustrating an alternate embodiment of the invention.

The separation of the tensile load carrying means for carrying the radial pressure has many advantages. FIG. 5 illustrates an arrangement in which a pair of tubular shells 41 and 42 are provided coaxially in one riser section. It is intended that the drilling mud, etc. generally will be contained by shell 42, but if this shell should fail for some reason or another, shell 41 will act as a backup to prevent escape. If desired, apertures with one-way valves can be provided in shell 41 to allow sea water and the like normally to flow between the two shells. Moreover, it should be noted that only one set of tensile carrying rods at locations 43 is required—that is, even though there are two shells only one tensile carrying rod arrangement is necessary—the embodiment of FIG. 5 is not simply a duplication.

Figure 6:
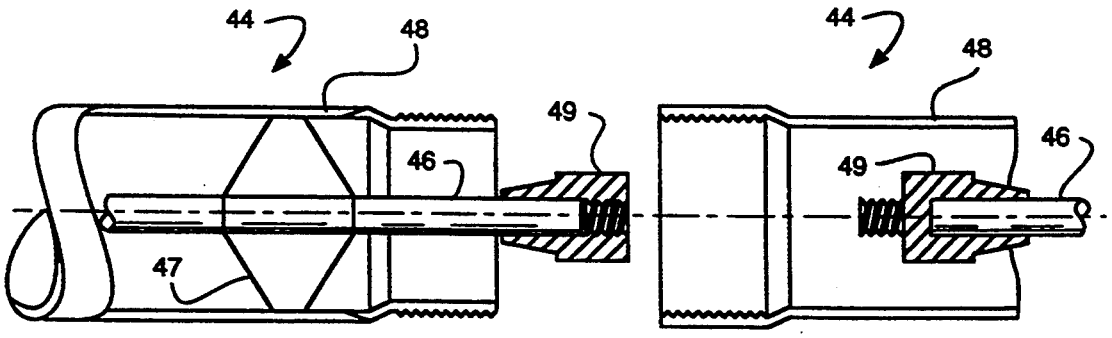
FIG. 6 is a diagrammatic sectional view illustrating another alternate embodiment of the invention.

In some situations, notably in most production arrangements, the central area within the riser section is free. FIG. 6 shows such an arrangement in which because such central area is free, each section 44 is provided with a tensile load carrying rod 46 extending along its central longitudinal axis. Such rods can be held in position centrally by appropriate structure, such as the spider arrangement indicated at 47. The shells 48 of the adjacent riser sections can be connected, for example, by threaded couplings as illustrated, and the rods 46 are similarly connected by threads provided by female and male coupling connectors 49. It should be noted that although it is contemplated in this embodiment that only a center rod arrangement will be provided, in some situations it may be desirable to have symmetrically arranged (outer or inner) rods as well.

Figure 7:
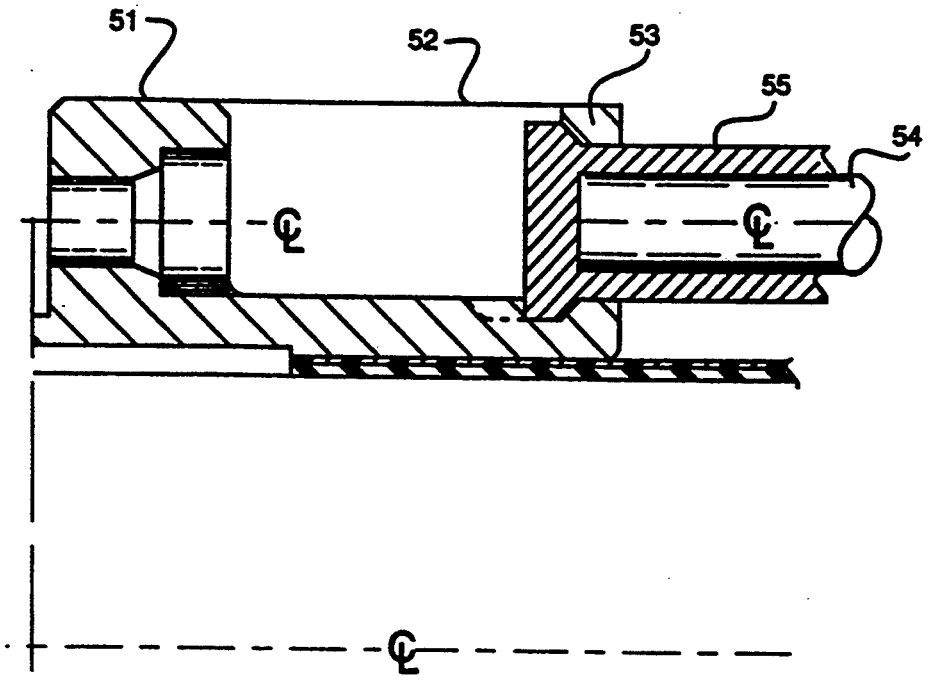

It is standard in the industry now to have relatively large steel couplers between riser sections. FIG. 7 illustrates an arrangement in which the instant invention is adapted to the design of such couplers. With reference to such figure the coupler 51 is standard, except that it has a gusset 52 extending inwardly of the riser section to provide an opening surrounded by a significant shoulder 53. The tensile carrying rod represented at 54 has an end fitting 55 which fits in such shoulder to transfer the tensile load on the same to the coupler via the adjacent integral flanges. A bolt or the like (not shown) can be used as is common to bolt the coupler 51 of one riser section to a coupler on the adjacent riser section and transmit the tensile load thereto.

Figure 8:
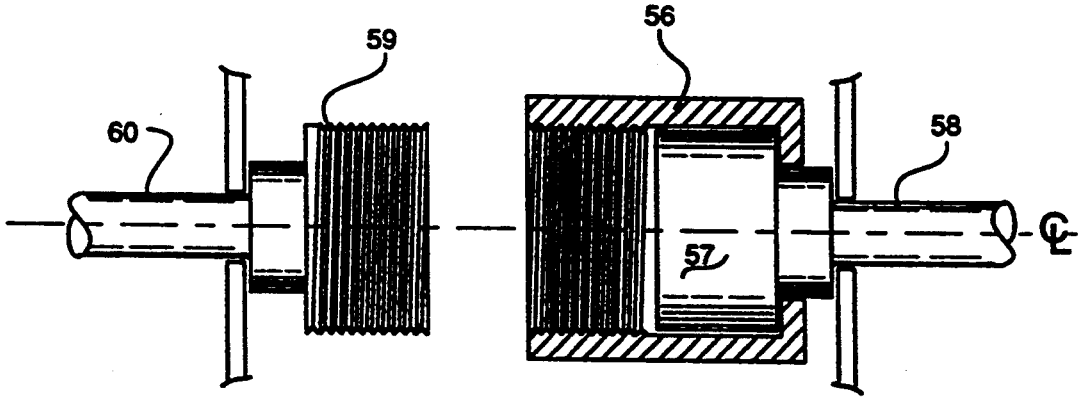
FIG. 8 illustrates another means for connecting the end of a rod of one riser section to the end of a rod of an adjacent riser section.

FIG. 8 illustrates an alternate arrangement for connecting the tensile carrying rod of one riser section to the tensile carrying rod of an adjacent section. A coupling 56 is provided housing an enlarged end piece 57 secured to an end of its associated rod 58. Such coupling is interiorly threaded as illustrated to receive exterior threads on an end piece 59 of a rod 60 of the adjacent riser section. The advantage of a coupling arrangement such as this is that the length of the tensile carrying rod 60 of the adjacent riser section can be adjusted via the threads as is appropriate.

Figure 9:
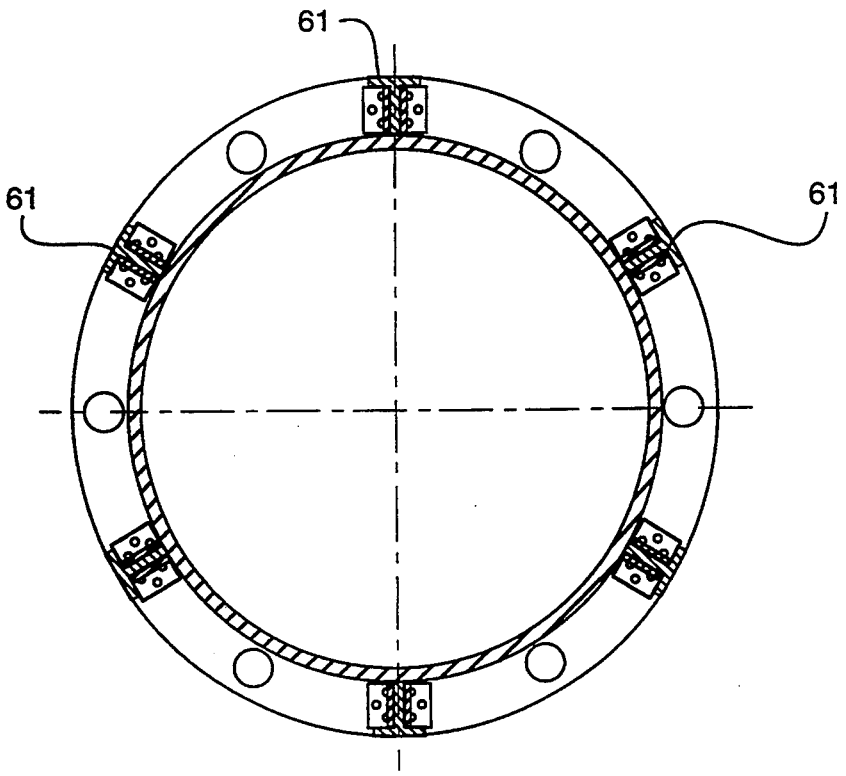
FIG. 9 is a sectional view similar to FIGS. 4 and 5, showing yet another alternate embodiment.

It is not necessary that the tensile carrying rod have a cylindrical section. In fact, in many situations it is desirable that the rods be pultrusion rods made up of several different materials. FIG. 9 illustrates an arrangement in which the tensile carrying rods represented at 61 are T-shaped formed of differing materials by, for example, pultrusion. I-beam rods or, for that matter, rods having any desired cross-sectional shape are within the broad scope of the invention.

Figure 10:
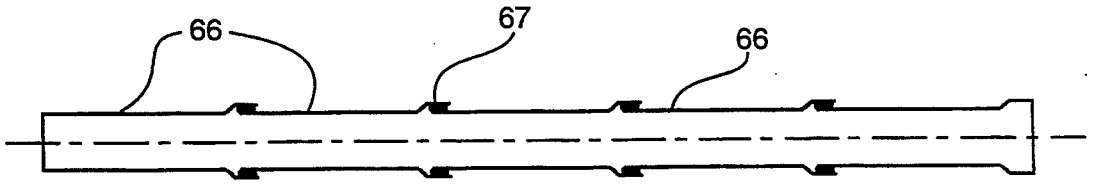
FIG. 10 is a schematic view illustrating yet another embodiment of the invention.

The removal of the tensile load from the portion of each section which is subjected to the radial pressure of the contents of the riser section provides many advantages as mentioned previously. FIG. 10 illustrates an arrangement in which the shell for a single riser is made up of sections 66, e.g., ten foot sections 66 for a full riser section. The sections are adhered together at overlapping joints 67 as illustrated, by an epoxy or other suitable adhesive. With such an arrangement it will be recognized that if one of the sections 66 becomes damaged, it is a simple procedure to replace the same without having to replace the full riser section tubular shell. Since with the instant invention the shell is not required to resist tensile loading, apertures, tubing, etc. can extend through the wall of the shell without interfering with the tensile load capacity of the riser section.

As mentioned at the beginning of the detailed description, applicant is not limited to the specific embodiments described above. Various changes and modifications can be made. For example, although it is contemplated that each riser section in a string be one incorporating the instant invention, it will be recognized that in some situations it may be desirable to also include in the string riser sections which do not incorporate the invention. The claims, their equivalents and their equivalent language define the scope of protection.

What is claimed is:

1. A rigid riser section having opposed ends, for use with a fossil fuel borehole comprising the combination of:

(a) means for carrying radial pressures expected to be applied to said riser section; and (b) means separate from said radial pressure carrying means, for transferring tensile loads between said opposed ends, said means extending generally for the full length of said riser section.

2. The riser section combination of claim 1 wherein said means for carrying radial pressures expected to be applied to said riser section is a tubular shell.

3. The riser section combination of claim 2 further including one or more carriers on said tubular shell for carrying said means which is separate from said shell for transferring tensile loads between said opposed ends.

4. The riser section combination of claim 3 wherein said means for transferring tensile loads includes a plurality of rods which extend for the length of said tubular shell.

5. The riser section combination of claim 2 wherein said tubular shell is a composite of two differing materials.

6. The riser section combination of claim 5 further including a tubular liner within the interior of said shell to protect the interior surface thereof from material within said shell.

7. The riser section combination of claim 1 further including means at, at least one of said opposed ends of said riser section, for transmitting tensile loads transferred to the tensile load transferring means to an adjacent riser section in a string of riser sections.

8. The riser section combination of claim 7 wherein there are said means for transmitting tensile loads at both of said opposed ends.

9. The riser section combination of claim 7 wherein the load transmitting means includes means for physically connecting said riser section to said adjacent riser section.

10. The riser section combination of claim 7 wherein the load transmitting means is arranged to transmit tensile loads transferred thereto directly to means of said adjacent riser section for transferring tensile loads.

11. The riser section combination of claim 10 wherein said adjacent riser section also includes the combination of:

(a) means for carrying radial pressures expected to be applied to said adjacent riser section; and (b) means separate from said radial pressure carrying means, for transferring tensile loads between opposed ends of said riser section.

12. The riser section combination of claim 11 wherein the tensile load transferring means extends the length of said adjacent riser section.

13. The riser section combination of claim 12 wherein said load transferring means include at least one rod which extends the length of said adjacent riser section.

14. The riser section combination of claim 13 wherein there are a plurality of said rods.

15. The riser section combination of claim 14 wherein each of said rods is T-shaped in lateral cross section.

16. The riser section combination of claim 13 wherein said section has a central longitudinal axis and said rod extends along said axis.

17. The riser section combination of claim 13 wherein there are a plurality of said rods arranged symmetrically relative to said axis.

18. The riser section combination of claim 1 wherein said means for carrying radial pressure is a tubular shell, further including a second tubular shell coaxial with said first tubular shell.

19. A riser section for use with a fossil fuel borehole comprising the combination of:

(a) means for carrying radial pressures expected to be applied to said riser section;

(b) means separate from said radial pressure carrying means and extending the length of said riser section for transferring tensile loads expected to be applied to said riser section to opposed ends of said riser section; and (c) means at both of said opposed ends of said riser section for transmitting said tensile loads to adjacent riser sections in a string of riser sections, which means includes at each of said ends, means for physically connecting said riser section to an adjacent riser section.

20. The riser section combination of claim 19 wherein each of said adjacent riser sections also includes the combination of:

(a) means for carrying radial pressures expected to be applied to said adjacent riser section; and (b) means separate from said radial pressure carrying means, for transferring tensile loads expected to be applied to said adjacent riser section.

21. In a process for manufacturing a riser section to be used with a fossil fuel borehole, the steps of:

(a) providing means for carrying radial pressures expected to be applied to said riser section; and (b) providing separate means for transferring tensile loads expected to be applied to said riser section to opposed ends of said section.

22. The process of claim 21 further including the step of providing connectors at each of the ends of said tensile load transferring means, for transmitting any tensile load received by the same to adjacent riser sections.

* * * * *